US005613374A

United States Patent [19]

Rohde et al.

[11] Patent Number: 5,613,374

[45] Date of Patent: Mar. 25, 1997

[54] PROCESS FOR THE LOW TEMPERATURE SEPARATION OF AIR AND AIR SEPARATION INSTALLATION

[75] Inventors: Wilhelm Rohde, München; Anton Moll, Raisting, both of Germany

[73] Assignee: Linde Aktiengesellschaft, Wiesbaden, Germany

[21] Appl. No.: 307,626

[22] PCT Filed: Mar. 17, 1993

[86] PCT No.: PCT/EP93/00623

§ 371 Date: Dec. 14, 1994

§ 102(e) Date: Dec. 14, 1994

[87] PCT Pub. No.: WO93/19336

PCT Pub. Date: Sep. 30, 1993

[30] Foreign Application Priority Data

Mar. 20, 1992 [DE] Germany ..... 42 09 131.4
Jul. 21, 1992 [DE] Germany ..... 42 24 068.9

[51] Int. Cl.[6] ..... F25J 3/00

[52] U.S. Cl. ..... 62/643; 62/906; 62/924

[58] Field of Search ..... 62/22, 906, 924, 62/643

[56] References Cited

U.S. PATENT DOCUMENTS 5,237,823 8/1993 Cheung ..... 62/22

FOREIGN PATENT DOCUMENTS 0467395 1/1992 European Pat. Off. .
93/19336 9/1993 WIPO .

*Primary Examiner*—Ronald C. Capossela
*Attorney, Agent, or Firm*—Millen, White, Zelano, & Branigan, P.C.

[57] ABSTRACT

In the process for the low temperature separation of air, purified and cooled air is fed into a distillation system comprising at least one rectification column and there is rectified by a counter-current material exchange between a vapor and a liquid phase. The material exchange in at least one section in at least one rectification column is brought about by a packing having a specific surface area of at least 1000 $m^2/m^3$.

32 Claims, 4 Drawing Sheets

PROCESS FOR THE LOW TEMPERATURE SEPARATION OF AIR AND AIR SEPARATION INSTALLATION

The invention relates to a process for separating air at low temperature in which purified and cooled air is passed into a distillation system comprising at least one rectification column and therein is subjected to rectification in a counter-current material exchange between a vapor and a liquid phase, wherein the material exchange in at least one section of at least one rectification column is effected by a packing, as well as an air separation installation for carrying out the process.

For some time a start has been made in low temperature technology, in particular in the separation of air, to employ packings which hitherto have been employed mainly for other separation purposes. The expression "packing" in this context includes both structured packings as well as random packings (randomly, packed packing bodies).

For example, from EP-A-O 321 163 it is known to employ at least in a section of the low pressure column of a dual-stage air separator a packing. In this context it is proposed to employ packings known from other fields of distillation, because; so it is claimed; the special properties of the packing: are immaterial. Conventionally such, for example structured packings, have a specific surface area, (i.e. surface area available for the material exchange in relation to the overall volume of the packing) of 125 to 700 $m^2/m^3$. The employment of packings of higher density in industrial air separators has so far not been known. EP-A-O 467 395, in which in a broad sense a range between 250 and 1000 $m^2/m^3$ is mentioned, is limited in the concrete examples to specific surface areas of not more than 700 $m^2/m^3$.

Due to the pressure drop being lower as compared to columns equipped exclusively with conventional rectification trays, the process for a given set of products specifications can be operated at lower input pressure. However, the thereby attained reduced energy costs are counteracted by increased costs for the manufacture of the rectification column.

Accordingly, it is an object of the present invention to provide, a process and an apparatus of the aforesaid type which is economically particularly favorable, in particular in view of relatively low installation costs.

This object is attained in that the material exchange is effected in at least one partial region of at least one rectification column by a packing having a specific surface area of at least 1000 $m^2/m^3$.

Due to the input and withdrawal of different fractions, different sections of an air separation column generally are subject to different loadings, i.e. different throughput rates of vapor and liquid. If, in particular in sections of a rectification column for an air separation process subject to relatively low loading, a packing is employed, it was found within the scope of the invention, that due to the employment of a packing having a very high specific surface area the height of the corresponding column sections filled with packings will be considerably lower. Compared with the processes known according to the state of the art, a lower overall height of the column for a given material exchange effect results and combined therewith correspondingly lower installation costs. This applies of course to an increased extent to a rectification column wherein in all packed sections employ packing of at least 1000 $m^2/m^3$.

From earlier measurements in the range of specific surface areas up to about 500 $m^2/m^3$ one would, however, have expected that the hydraulic properties of a very dense packing would clearly deteriorate, that in particular the pressure loss per theoretical plate would increase appreciably with increasing packing densities and also that the column diameter required for a pre-set gas load would increase. Because of the well founded expectation that this inter-relationship would continue at higher absolute specific surface areas, such denser packings, because of the foreseeable economic disadvantages when employed in industrial air separators, ware not taken into consideration. Moreover, major problems concerning the distribution of gas and in particular of liquid on the packing as well as the cross-distribution of gas and liquid within the packing were to be expected.

Within the framework of extensive measurements carried out in an elaborate experimental installation under conditions of an industrial air separator, it was found that, in the case of the rectification of air gases the hydraulic deteriorations of packings having specific surface areas above about 1000 $m^2/m^3$ become very much lower than had to be expected, according to previous knowledge. This effect is so substantial that, when employing such denser packings in air rectification the advantages in respect to the installation costs clearly exceed the disadvantages in respect to hydraulics. This applies particularly when employing this kind of packings in sections of a column subjected to relatively low loads or in a column subject to constant gas loads. The dense pac-king as for the remainder preferably has an ordered structure, similarly, for example to that of the packings known from DE-C-27 22 424 or DE-B-27 22 556. However, it is preferred to employ a smooth packing the structure of which is described in German Patent Application P 42 09 132.2 having the same priority date as the instant application, and in the corresponding International Patent Application PCT/EP 93/00622 (internal docket H 92/31-WO) to which specific reference is made herein.

In an advantageous further development of the inventive concept the material exchange is effected in the upper and/or in the lower section of the rectification column at least partly by a packing which has a specific surface; area of at least 1000 $m^2/m^3$. The uppermost column section may for example, represent the pure nitrogen section of an air separation column through which only a part of the nitrogen product is conducted, and the lowermost section may represent the oxygen section which, as a rule, likewise is subjected to a relatively low throughput of gas and liquid. In those regions the particularly dense packing with respect to material exchange surface area can develop its advantages to the fullest.

This applies even more so in the case of the connection of a crude argon column to a low pressure column. Generally speaking, this represents the low pressure column of a dual-stage column. In principle, however, the connection of a crude argon column to a single column for nitrogen-oxygen separation is also possible. According to the invention, a packing having at least 1000 $m^2/m^3$ can be employed both in the crude argon column as well as in the low pressure column or merely in one of the two columns, for example, in the low pressure column.

It is particularly advantageous if the material exchange is brought about in a partial section of the crude argon column by a packing which has a specific surface area of at least 1000 $m^2/m^3$. In many cases a large part, substantially the entire or even the whole material exchange can be brought about in the crude argon column by such a packing.

As an example reference is made here to a process wherein oxygen and argon are separated purely by rectification in a crude argon column which contains packings and which has a very high theoretical plate number (EP-A-O 377 177). In that case, a very large structural height of the crude argon column results. Due to the employment according to the invention of a packing having a very high specific surface area, for example 1200 or 1500 $m^2/m^3$, the structural height of such a crude argon column and thereby the investment costs for the installation can be reduced decisively.

Also of advantage is the application of the invention to a dual-column process in which the distillation system comprises a pressure column and a low pressure column wherein at least a part of the purified and cooled air is passed into the pressure column and an oxygen-enriched and a nitrogen-rich fraction from the pressure column are fed into the low pressure column. This dual column may, for example, serve exclusively for the recovery of oxygen and/or nitrogen or there may be connected additional separating columns for the recovery of noble gases.

In a dual-column process the material exchange is preferably effected in at least a section of the low pressure column by a packing have a specific surface area of at least 1000 $m^2/m^3$. In particular, extensive sections or even the entire region of the low pressure column which is active for the material exchange may be equipped with a dense packing.

Due to the connection to the pressure column, which as a general rule is fitted below the low pressure column, the decrease in structural height resulting from the invention acts as a particularly important advantage. In certain cases the pumps for transporting the liquid fractions from the pressure column to the low pressure column which would otherwise be required, can be dispensed with. This applies in particular if the head of the low pressure column is cooled by indirect heat exchange with a fraction from the lower region of the pressure column. In the employment according to the invention of the dense packing, it is even possible for the level difference between the sump of the pressure column and the head of the low pressure column to be overcome solely by the prevailing pressure difference.

In case only part of the low pressure column is equipped with the packing of high specific surface area, it is advantageous if the material exchange in the section of the low pressure column which is below the feed locality of the oxygen-enriched fraction from the pressure column, is effected at least partly by a packing having a specific surface area of at least 1000 $m^2/m^3$. This section is generally known as the oxygen section. Since the feeds of the two fractions from the pressure column are positioned above this section, the latter is subject to relatively low load.

Similar considerations apply to the pure nitrogen section, which is positioned between the head of the low pressure column, where a pure nitrogen fraction is withdrawn, and the withdrawal position of an impure nitrogen fraction, underneath the head of low pressure column and above the argon intermediate section. The latter is positioned between the withdrawal locality of an argon-containing oxygen flow, which is passed to the crude argon column and the feed locality of a fraction evaporated in indirect heat exchange with gas from the head of the crude argon column. Preferably the material exchange in one of these sections or in both is at least partly effected by a packing having a specific surface area of at least 1000 $m^2/m^3$.

In addition, it is also possible for the material exchange in the pressure columns to be effected at least in part by a packing. This can be a packing of high specific surface area, but the employment of a packing of lesser density is also possible. The exclusive employment of a very dense packing in the pressure column will be considered more rarely. The invention also relates to an air separation installation which uses a distillation system comprising at least one rectification column including material exchange elements, wherein the material elements in at least one section of at least one rectification column are formed by a packing having a specific surface area of at least 1000 $m^2/m^3$.

In the following the invention as well as further details of the invention will be further explained with reference to working examples which are schematically illustrated in the drawings. The processes illustrated in the figures each comprises at least two rectification stages; however, the invention is also applicable to single-stage air separation processes.

BRIEF DESCRIPTION OF THE DRAWING

The mutually corresponding process steps and apparatus features are denoted in the working examples by the same reference numbers.

Figure 1:
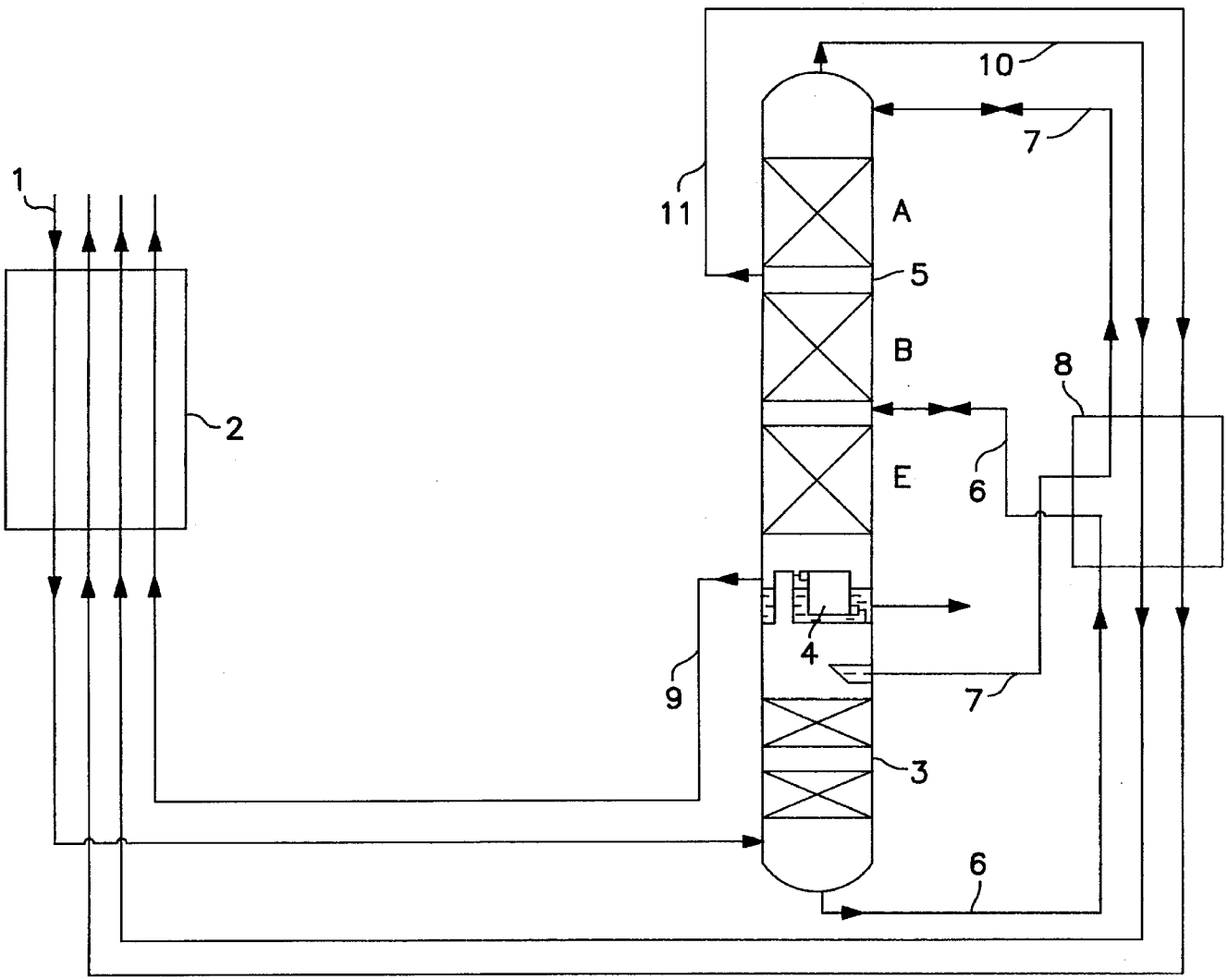
FIG. 1 illustrates an air separation process according to the invention with three sections in the low pressure column.

In the process illustrated in the diagram of FIG. 1 purified air 1 under a pressure of 4 to 20 bar, preferably 5 to 12 bar, is cooled in a heat exchanger 2 against product flows approximately down to dew point and fed into the pressure column 3 of a dual-stage rectification installation. The pressure column 3 is in heat exchange relationship with a low pressure column 5 by way of a common, condenser-evaporator 4.

Sump liquid 6 and nitrogen 7 are withdrawn from the pressure column 3, supercooled in a counter-current apparatus 8 and bled into the low pressure column 5. Oxygen 9, nitrogen 10 and impure nitrogen 11 are withdrawn from the low pressure column. The products may optionally at least in part be withdrawn in liquid form. For the sake of clarity this is riot illustrated in the process diagram.

The low pressure column 5 in the process and apparatus according to FIG. 1 comprises the following sections:

A Pure nitrogen section (above the impure nitrogen duct 11)

B Impure nitrogen section (limited by the impure nitrogen duct 11 and the sump liquid duct 6)

E Oxygen section (below the inlet of the sump liquid line 6)

Figure 2:
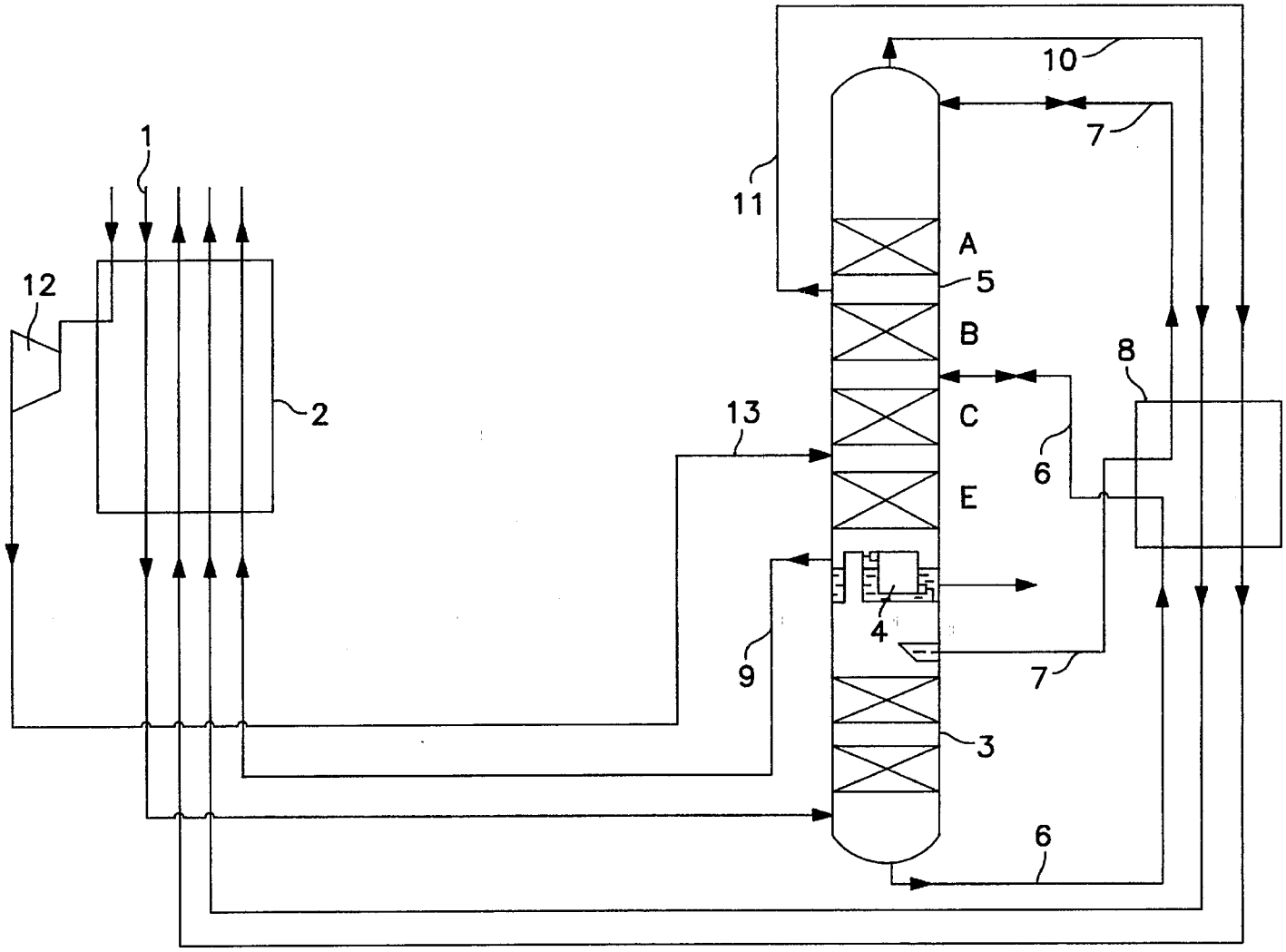
FIG. 2 illustrates an air separation a process comprising four sections in the low pressure column in which, in addition, a part of the air is directly blown into the low pressure column.

In the embodiment illustrated in FIG. 2 of the process and apparatus according to the invention, a part of the air to be separated is depressurized in a turbine 12 with the performance of work and blown directly into the low pressure column 5 by way of the duct 13, by-passing the pre-separation in the pressure column 3. In this context the turbine air 13 may, for example, be fed into the low pressure column at the level of the sump liquid line 6; however, more advantageous is a feeding in the region below the sump liquid inlet as illustrated in FIG. 2. This results in the definition in the low pressure column of altogether four sections:

A and B as in FIG. 1

C impure oxygen section (limited by the sump liquid duct 6 and the injection duct 13 for turbine air)

E Oxygen section (underneath the inlet of the injection duct 23)

Figure 3:
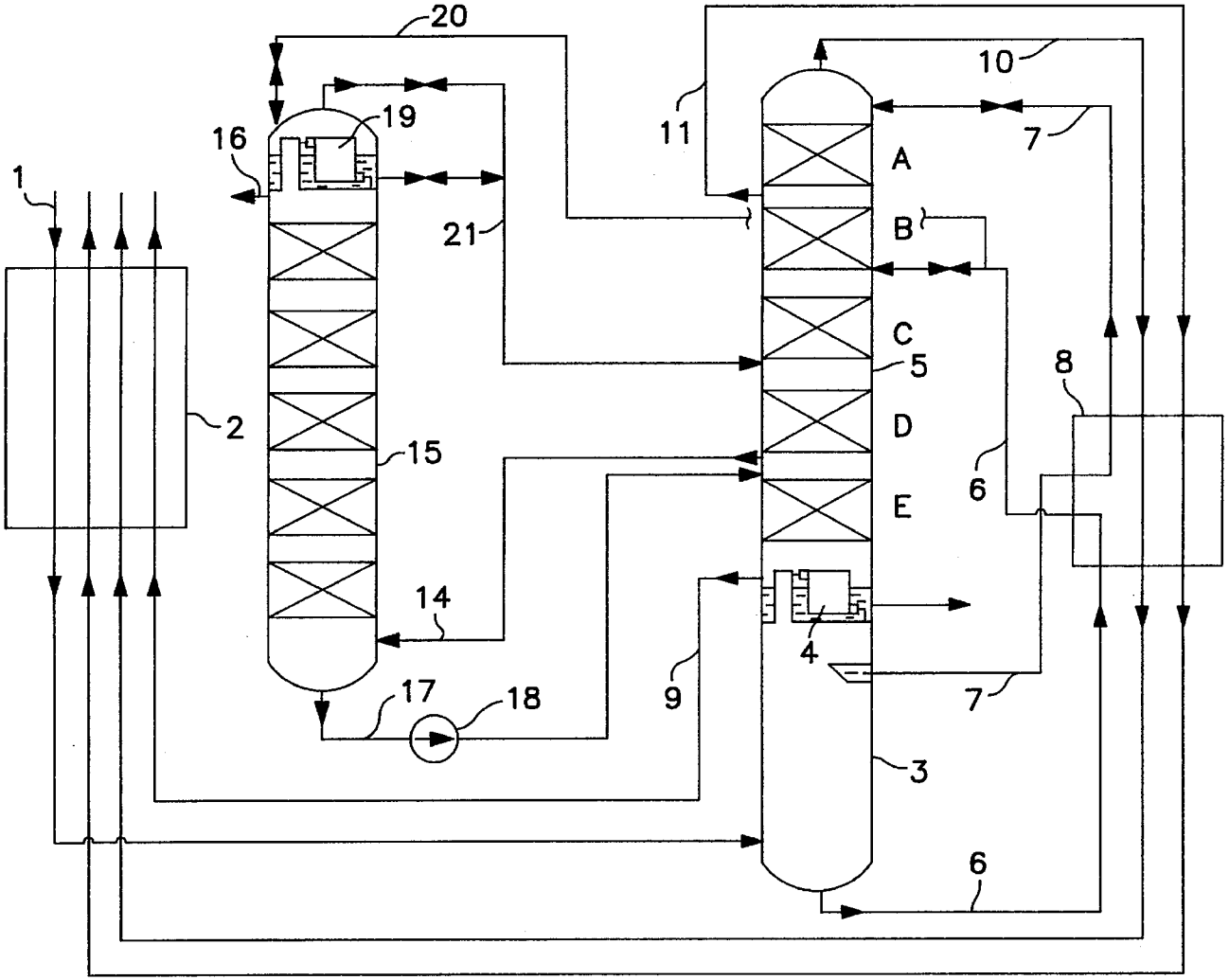
FIG. 3 illustrates another modification of the process according to the invention wherein crude argon column is connected to the low pressure column and the low pressure column contain five section.

In FIG. 3, a crude argon column is connected to the air rectification. An argon containing oxygen flow is withdrawn from the lower region of the low pressure column 5 (underneath the sump liquid duct 6) by way of an argon transfer duct 14, is passed into the lower region of the crude argon column 15 and therein is separated into a crude argon product 16 and a residual fraction 17. The residual fraction is returned into the low pressure column 5. It may either flow back by way of the duct 14 (if an appropriate fall is present) or, as shown in FIG. 3, be conveyed by means of a pump 18 through a special duct 17.

The head of the crude argon column is cooled by a crude argon condenser 19 on the evaporation side of which sump liquid from the pressure column 3 supplied by way of the duct 20 is evaporated. The evaporated fraction is passed by way of duct 21 to the low pressure column 5. May, for example, be introduced at the level of the sump liquid duct 6. It is, however, particularly advantageous to feed the evaporated fraction into low pressure column 5 between the inlet of the sump liquid duct 6 and the connection of the argon transfer duct 14.

Due to the-described procedure, the following sub-divisions result in the low pressure column of FIG. 3:

A and B as in FIG. 1

C Impure oxygen section (limited by the sump liquid duct 6 and a duct 21 for the introduction of evaporated fraction from the crude argon condenser 19)

D Argon intermediate section (limited by duct 21 for the introduction of the evaporated fraction from the crude argon condenser 19 and withdrawal duct 14 for the argon-containing oxygen fraction which is to be separated in the crude argon column)

E Oxygen section (underneath the withdrawal duct 14 for the argon-containing oxygen fraction to be separated in the crude argon column)

Figure 4:
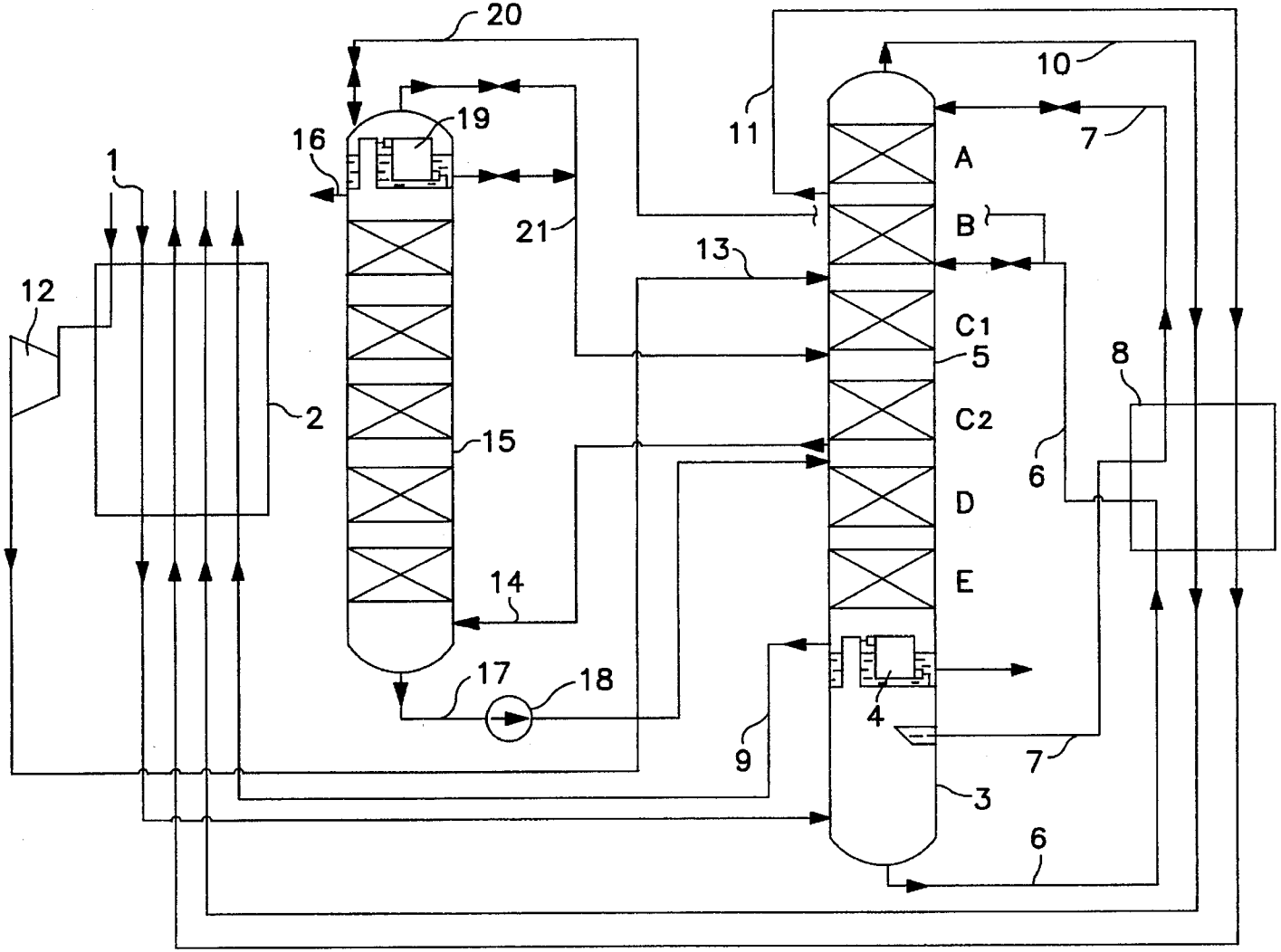
FIG. 4 illustrates a further modification comprising a crude argon column and direct air injection with six sections in the low pressure column.

In FIG. 4 a combination of the embodiments of FIGS. 2 and 3 is illustrated. Starting from FIG. 3, according to an additional feature, air, depressurized in a turbine 12 with the performance of work, is directly blown into the low pressure column 5. Similar to the procedure according to FIG. 2 it is possible to introduce the turbine air, for example, at the level of the sump liquid duct 6. As shown in FIG. 4 it is preferably fed in the region between the sump liquid feed point 6 and the feed points of the evaporated fraction 21 from the crude argon condenser 19. Thus, the impure oxygen section is further sub-divided into two sub-sections $C_1$ and $C_2$.

According to the invention, the material exchange is brought about in several sections of the low pressure column 5 and/or the crude argon column 15 at least in part by a packing having a specific surface area of at least 1000 $m^2/m^3$.

In order to give effect to the invention, it is not necessary to employ packings in all sections of the low pressure column; in one or more sections the material exchange can also partly or wholly be effected by other material exchange elements, for example by conventional rectification plates such as bubble cup trays or sieve trays. In one section in which in one or more partial sections a packing is provided, the material exchange may in other partial section be effected by different material exchange elements. Preferably packings are predominantly employed for effecting the material exchange may all sections of the low pressure column 5.

A simple form for realizing the invention is a process according to FIG. 1 in which in a nitrogen section, for example, that in the oxygen section E and/or in the pure nitrogen section, a packing is employed having a specific surface area of at least 1000 $m^2/m^3$.

The following table illustrates a numerical example for a low pressure column having five sections according to FIG. 3. The denotation of the sections in the working examples of the remaining figures is so selected that the values of the table can be transferred directly to these embodiments. The table contains for each of the sections A to E a numerical range for the load (throughput of rising gas) in relation to the impure nitrogen section B, a preferred numerical range for a packing to be employed in the section as well as two particularly preferred numerical data of concrete working examples.

TABLE

| Section | Relative Load % | Specific Surface Area $m^2/m^3$ | | |
|---|---|---|---|---|
| A Pure nitrogen section | 60–75 | 600–1250 | 750 | 1100 |
| B Impure nitrogen section | 100 | 350–800 | 500 | 750 |
| C Impure oxygen section approx. | 90 | 350–800 | 500 | 750 |
| D Argon intermediate section | 40–50 | 600–1500 | 1100 | 1250 |
| E Oxygen section | 75–85 | 500–1250 | 750 | 1100 |

From the table it is apparent that in section B, which is subjected to the highest loading, a relatively coarse packing is employed. Sections subject to lower loads, for example section E, are preferably equipped with finer packings. The argon intermediate section D preferably contains a packing having a particularly high specific surface area. The value of 1500 $m^2/m^3$ in this case is not an upper limit. In principle higher specific surfaces are also conceivable.

The packings employed in various sections may in other respects have the same or different structures. However, preferably structured packings such as described in patent application P 42 09 132.2 filed simultaneously herewith are employed in one or several or all sections. Different specific surface areas are obtained by different amplitudes in folding the lamellae, from which the packings are produced.

Due to the employment in accordance with the invention of packings having very high specific surface areas the construction height of the low pressure column 5 according to the working examples and would for example be the case if exclusively packings have a specific surface area of less than 1000 $m^2/m^3$ had been employed.

In the working examples according to FIGS. 1 to 4, respectively 3 and 4, the material exchange may also in the pressure column 3 and/or in particular in the crude argon column 15 be effected in one or more sections or in the entire column by packings. These preferably likewise comprises the structure as described in German Patent Application P 42 09.12,2.2 respectively International Patent Application PCT/EP 93/00622.

It is also possible to employ in the crude argon column packings of different specific surface areas. Preferably, however, a packing having a constant specific surface area is used. The particularly preferred magnitudes of the specific surface area of this picking lie in the range of about 1000 to 1500 $m^2/m^3$, preferably at 1100 to 1250 $m^2/m^3$. Preferably, essentially the entire material exchange in the crude argon column 15 takes place in such a dense packing.

If even in the low pressure column or in the pressure column a packing having a specific surface area of at least 1000 $m^2/m^3$ is employed, it is also possible for the packing densities in the crude argon column to be below this limit, preferably at 700 to 900 $m^2/m^3$, in particular at about 750 $m^2/m^3$.

The employment according to the invention of a particularly dense packing is especially advantageous in air separating installations and processes in which a rectification column is installed in a vacuum vessel, for example, a liquid tank. (Details of such process and apparatus will be apparent from the older Patent Application P 41 35 302.1.) Due to the installation of a/packing having a specific surface area of at least 1000 $m^2/m^3$ in one or more sections or in the entire region effective for material exchange in such a column, it is possible to reduce the structural height. This results not only in a reduction of the manufacturing costs of the column itself, but also of those of the vacuum vessel surrounding it.

Besides, the application of the invention is also advantageous to processes and apparatus in which oxygen recovered in liquid form is evaporated in heat exchange with a condensing fraction (for example high pressure air). In such processes the oxygen product is frequently pressurized in liquid form (so-called internal compression), for example, by utilizing a hydrostatic potential or by a pump. In the case of feeding air condensed in heat exchange with evaporating oxygen in a middle position of the pressure column, it can be advantageous to employ packings of different densities in the pressure column above and below such feed position.

We claim:

1. In a process for separating air at low temperature in which purified and cooled air is passed into a distillation system comprising at least one rectification column having at least one mass transfer section and wherein countercurrent mass transfer between a vapor and a liquid phase is conducted in said at least one section of said at least one rectification column, the improvement wherein mass transfer is effected in at least part of at least one mass transfer section of said at least one rectification column by a packing having a specific surface area of at least 1100 $m^2/m^3$.

2. A process according to claim 1, wherein said at least one rectification column has at least an uppermost mass transfer section and a lowermost mass transfer section and mass transfer in said uppermost section of said at least one rectification column is effected by a packing having a specific surface area of at least 1000 $m^2/m^3$.

3. A process according to claim 1, wherein said at least one rectification column has at least an uppermost mass transfer section and a lowermost mass transfer section and mass transfer in said lowermost section of said at least one rectification column is at least in part effected by a packing having a specific surface area of at least 1000 $m^2/m^3$.

4. A process according to claim 1, wherein said distillation system comprises a high pressure column, a low pressure column and a crude argon column and an argon-containing oxygen flow is withdrawn from said low pressure column and is separated in said crude argon column into crude argon and a residual fraction.

5. A process according to claim 4, wherein the mass transfer in at least one mass transfer section of said crude argon column is effected by a packing having a specific surface area of at least 1000 $m^2/m^3$.

6. A process according to claim 5, wherein mass transfer in at least one mass transfer section of said crude argon column is effected by a packing having a specific surface of 1200–1500 $m^2/m^3$.

7. A process according to claim 5, wherein the entire mass transfer in said crude argon section is effected by a packing having a specific surface area of 1100–1250 $m^2/m^3$.

8. A process according to claim 4, wherein a first portion of sump liquid from said high pressure column is introduced into said low pressure column and a second portion of sump liquid from said high pressure column is introduced into said crude argon column.

9. A process according to claim 4, wherein at least part of the purified and cooled air is fed into said high pressure column.

10. A process according to claim 1, wherein the distillation system comprises a high pressure column and a low pressure column, at least part of said purified and cooled air is fed into said high pressure column and an oxygen-enriched fraction and a nitrogen-rich fraction are removed from said high pressure column and fed into said low pressure column at respective feed points therein, each of said high pressure and low pressure columns having a head and a bottom.

11. A process according to claim 10, wherein mass transfer in at least one mass transfer section of said low pressure column in effected by a packing having a specific surface area of at least 1000 $m^2/m^3$.

12. A process according to claim 11, wherein mass transfer in a mass transfer section of said low pressure column below the feed point of said oxygen-enriched fraction from said high pressure column is effected at least in part by a packing having a specific surface area of at least 1000 $m^2/m^3$.

13. A process according to claim 10, wherein at the head of said low pressure column a pure nitrogen fraction is withdrawn and below the head of said low pressure column an impure nitrogen fraction is withdrawn and mass transfer in a mass transfer section of said low pressure column positioned between the withdrawal points for the pure and impure nitrogen fractions is at least in part effected by a packing having a specific surface area of at least 1000 $m^2/m^3$.

14. A process according to claim 10, wherein an argon-containing oxygen flow is withdrawn from said low pressure column underneath the feed point for said oxygen-enriched fraction and is separated in a crude argon column into crude argon and a residual fraction;

gas from the head of said crude argon column is brought into indirect heat exchange with an evaporating fraction from said high pressure column; and the fraction evaporated due to said indirect heat exchange is fed into said low pressure column and mass transfer in the mass transfer section of said low pressure column positioned between the feed point for the evaporated fraction and the withdrawal point for said argon-containing oxygen flow is effected at least in part by a packing having a specific surface area of at least 1000 $m^2/m^3$.

15. A process according to claim 10, wherein mass transfer in said high pressure column is effected at least in part by a packing.

16. A process according to claim 10, wherein mass transfer in at least one mass transfer section of said high pressure column is effected by a packing having a specific surface area of at least 1000 $m^2/m^3$.

17. An air separation installation for carrying out the process according to claim 1 comprising at least one rectification column including mass transfer elements, wherein the mass transfer elements in at least one mass transfer section of said at least one rectification column are a packing having a specific surface area of at least 1100 $m^2/m^3$.

18. An air separation installation according to claim 17, wherein said at least one rectification column has an upper section and a lower section and mass transfer elements in said upper section are at least in part a packing having a specific surface area of at least 1000 $m^2/m^3$.

19. An air separation according to claim 17, wherein said at least one rectification column has an upper section and a lower section and mass transfer elements in said lower section of the rectification column are at least in part a packing having a specific surface area of at least 1000 $m^2/m^3$.

20. An air separation installation according to claim 17, wherein said distillation system comprises a high pressure column, a low pressure column and a crude argon column and said low pressure column and crude argon column are interconnected by way of an argon transfer duct.

21. An air separation installation according to claim 20, wherein the mass transfer elements in a mass transfer section of said crude argon column are formed by a packing having a specific surface area of at least 1000 $m^2/m^3$.

22. An air separation installation according to claim 17, wherein the distillation system comprises a high pressure column and a low pressure column, a feed duct for air to be separated is connected to said high pressure column, and a sump liquid duct and a compressed nitrogen duct connect said high pressure column and said low pressure column.

23. An air separation installation according to claim 22, wherein the mass transfer elements in at least one mass transfer section of said low pressure column are formed by a packing having a specific surface area of at least 1000 $m^2/m^3$.

24. An air separation installation according to claim 23, wherein the mass transfer elements in the at least one section of said low pressure column below the entry point of said sump liquid duct are at least in part a packing having a specific surface area of at least 1000 $m^2/m^3$.

25. An apparatus according to claim 22, wherein said low-pressure column has an upper region and a lower region, a pure nitrogen duct is connected to said upper region of said low pressure column and an impure nitrogen duct is connected to said low pressure column underneath said pure nitrogen duct, the mass transfer elements in the mass transfer section of said low pressure column situated between said pure nitrogen duct and said impure nitrogen duct are at least in part a packing having a specific surface area of at least 1000 $m^{2/m3}$.

26. An air separation installation according to claim 22, wherein an argon transfer duct is connected below the entry point of said sump liquid duct to said low pressure column and leads into a crude argon column, said crude argon column comprising a head condenser the evaporation space of which is connected by way of a liquid duct to said high pressure column and by way of a gas duct to said low pressure column, and the mass transfer elements in the section of said low pressure column positioned between the entry point of said gas duct and said argon transfer duct are at least in part a packing having a specific surface area of at least 1000 $m^2/m^3$.

27. An air separation installation according to claim 22, wherein the mass transfer elements in said high pressure column are at least partly a packing.

28. An air separation installation according to claim 22, wherein the mass transfer is brought about in at least one mass transfer section of said high pressure column by a packing having a specific surface area of at least 1000 $m^2/m^3$.

29. A process according to claim 1, wherein said at least one rectification column has at least an uppermost mass transfer section and a lowermost mass transfer section and mass transfer in said lowermost section of said at least one rectification column is effected by a packing having a specific surface area of 750–1250 $m^2/m^3$.

30. A process according to claim 1, wherein said at least one rectification column has an uppermost pure nitrogen packing section, an intermediate argon packing section and a lowermost oxygen packing section, wherein mass transfer in said intermediate argon packing section is effected by a packing having a specific surface area of at least 1250 $m^2/m^3$.

31. A process according to claim 1, wherein said at least one rectification column has at least an uppermost mass transfer section and a lowermost mass transfer section and mass transfer in said uppermost section of said at least one rectification column is effected by a packing having a specific surface area of 750–1250 $m^2/m^3$.

32. A process according to claim 1, wherein all packing sections of said at least one rectification column have a specific surface area of at least 750 $m^2/m^3$.

* * * * *